US005243706A

United States Patent [19]

Frim et al.

[11] Patent Number: 5,243,706

[45] Date of Patent: Sep. 14, 1993

[54] MICRO-CLIMATE CONDITIONING CLOTHING

[75] Inventors: John Frim, Bramalea; Robert D. E. Michas, Brampton, both of Canada

[73] Assignee: Minister of National Defence of Her Majesty's Canadian Goernment, Canada

[21] Appl. No.: 844,100

[22] Filed: Mar. 2, 1992

[30] Foreign Application Priority Data

Sep. 13, 1991 [CA] Canada ..... 2051358

[51] Int. Cl.[5] ..... A41D 13/00

[52] U.S. Cl. ..... 2/2; 2/81; 2/97; 2/102; 2/DIG. 1; 428/138; 428/255

[58] Field of Search ..... 2/102, 97, 171.3, DIG. 1, 2/DIG. 3, 2, 2.1 R, 2.1 A, 69, DIG. 10, 87, 7, 92, 81; 428/138, 255

[56] References Cited

U.S. PATENT DOCUMENTS

| | | | |
|---|---|---|---|
| 2,231,129 | 2/1941 | Levy | 2/97 |
| 2,976,539 | 3/1961 | Brown, Jr. | 2/97 |
| 3,710,395 | 1/1973 | Spano et al. | 2/DIG. 1 |
| 4,434,514 | 3/1984 | Sundahl et al. | 2/171.3 |
| 4,502,153 | 3/1985 | Lapedes et al. | 2/97 |
| 4,774,725 | 10/1988 | Page | 2/97 |
| 4,964,282 | 10/1990 | Wagner | 2/DIG. 1 |
| 4,985,933 | 1/1991 | Lemoine | 2/DIG. 1 |
| 5,005,216 | 4/1991 | Blackburn et al. | 2/171.3 |
| 5,072,455 | 12/1991 | St. Ours | 2/102 |
| 5,136,723 | 8/1992 | Aldridge et al. | 2/87 |
| 5,172,426 | 12/1992 | Capello | 2/7 |

FOREIGN PATENT DOCUMENTS

| | | | |
|---|---|---|---|
| 2722816 | 11/1978 | Fed. Rep. of Germany | 2/97 |
| 463424 | 2/1914 | France | 2/102 |
| 2459012 | 2/1981 | France | 2/DIG. 3 |

*Primary Examiner*—Clifford D. Crowder
*Assistant Examiner*—Amy Brooke Vanatta
*Attorney, Agent, or Firm*—Nolte, Nolte & Hunter

[57] ABSTRACT

Heat control for an animal body is provided by way of micro-climate conditioning clothing incorporating an inner first layer of spacer mesh material. A second layer of impermeable material is in contact with the first layer and has perforations therethrough. A third layer of spacer mesh material is provided as well as a fourth outer layer of impermeable material which is fastened along its edges to the second layer. An inlet/outlet port for a gaseous fluid is provided.

23 Claims, 2 Drawing Sheets

MICRO-CLIMATE CONDITIONING CLOTHING

FIELD OF THE INVENTION

This invention relates to heat control means for an animal body.

Animal bodies, particularly human bodies, function most efficiently and effectively when maintained at a temperature within a certain range. This is especially true for aircrew, tankcrew, rapid runway repair crew and firemen.

BACKGROUND OF THE INVENTION

As is well known, it is desirable to reduce or prevent heat strain in individuals due to the accumulation of metabolic and/or external heat in certain circumstances. Military aircrew, in particular, require various types of protective equipment and clothing (i.e. counter pressure, immersion, chemical defense) that can inhibit adequate dissipation of body heat, even in a conditioned aircraft environment. Such clothing is often referred to as micro-climate conditioning clothing.

Liquid cooling vests have previously been provided for aircrew but some models have had disadvantages. The performance thereof has been dependent on good contact between the vest and the body and this has been difficult to ensure and can vary with body movement.

Furthermore, in prior vests flow of the cooling liquid can be reduced or stopped by a "kink" in one of the flexible members forming a flow path in the vest. Prior air vests have had difficulty in directing cooling air so that it flowed across the body. Instead, the cooling air moved away from the body immediately after reaching a respective distribution site.

Consequently, only a portion of the cooling potential of the air was used so that the performance was low or the flow rate had to be higher than might otherwise be required in order to achieve the desired cooling effect.

It is an object of the present invention to provide heat control means in which the above-identified disadvantages are substantially reduced or obviated.

SUMMARY OF THE INVENTION

According to the present invention there is provided heat control means for an animal body comprising an inner first layer of spacer mesh material, a second layer of impermeable material adjacent said inner layer and having perforations therethrough adjacent said inner layer, a third layer of spacer mesh material, and an outer layer of impermeable material, said heat control means being provided with connection means for a gaseous fluid.

More specifically there is provided micro-climate conditioning clothing comprising an inner first layer of spacer mesh material, a second layer of impermeable material in contact with said first layer and having perforations therethrough adjacent said first layer, a third layer of spacer mesh material on the opposite side of said second layer to said first layer and a fourth layer of impermeable material on the side of said third layer remote from said second layer, the second and fourth layers being fastened together along at least part of their edges to form a space therebetween, and fluid flow means connected to said space for fluid flow connection thereto.

Perforations may be provided over only a part of said second layer at selected sites for appropriate control of air distribution. Different clothing may have perforations through the second layer at different sites depending on the area to be cooled. Control flaps, or other means, may be provided for covering selected perforations.

BRIEF DESCRIPTION OF THE DRAWINGS

An embodiment of the present invention will now be described, by way of example, with reference to the accompanying drawings in which.

DESCRIPTION OF THE PREFERRED EMBODIMENT

Figure 1:
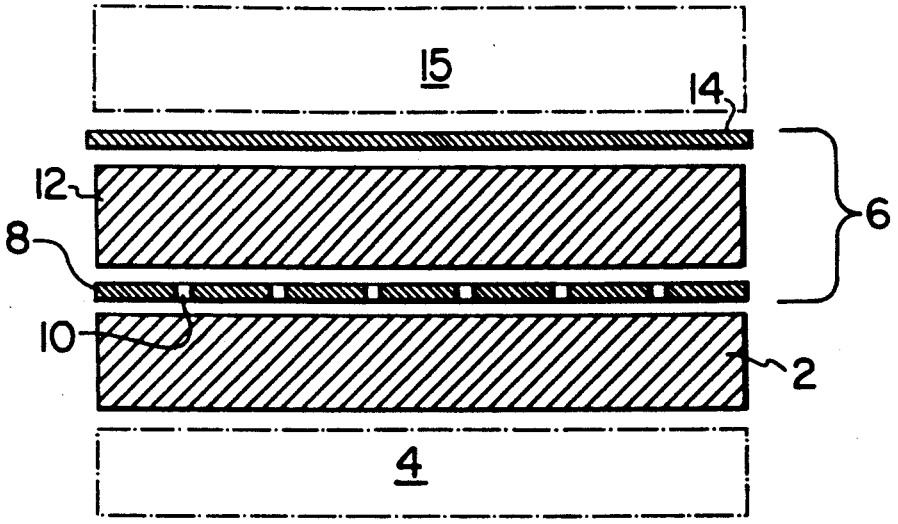
FIG. 1 is a cross-sectional diagrammatic representation of part of an air vest to show the construction thereof.

Referring to FIG. 1 a cooling vest for a human being comprises a spacer mesh layer 2 which, in use, is in proximity to the body 4 of a user and covers specific areas of the body, e.g. the front and back torso above the waist. The vest may actually be in contact with the body or, alternatively, a t-shirt, underwear, or a turtleneck may be worn under the layer 2. An air distribution manifold member 6 is provided in contact with the layer 2 and itself comprises a layer 8 of impermeable coated fabric material having a plurality of perforations 10 therethrough. An intermediate layer 12 of spacer mesh material is sandwiched between layer 8 and an outer layer 14 of impermeable material. The outer layer 14 is bonded to the inner layer 8 and will, for example, be just inside a flight coverall 15 worn by the user.

Figure 2:
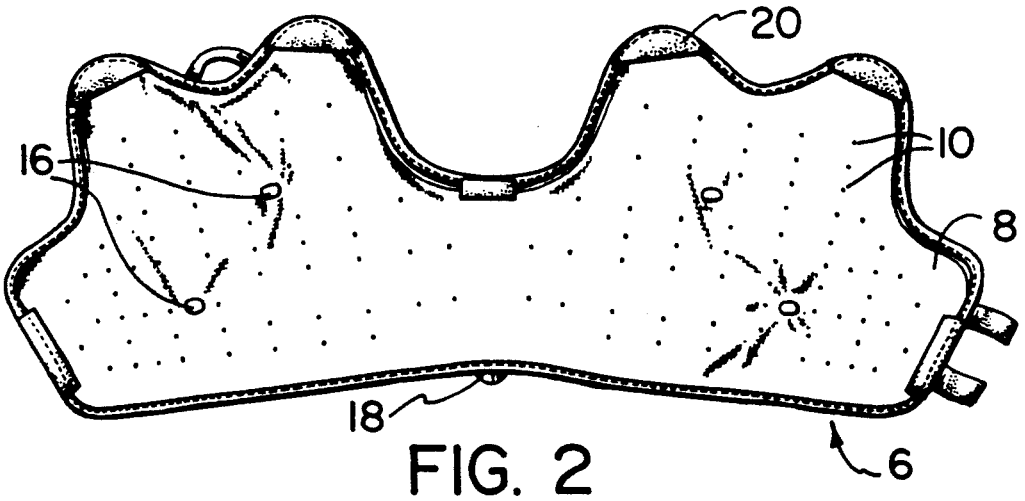
FIG. 2 is a diagrammatic representation of a distribution manifold of an air vest showing the surface thereof which, in use, would be closest to the body of the wearer.
Figure 3:
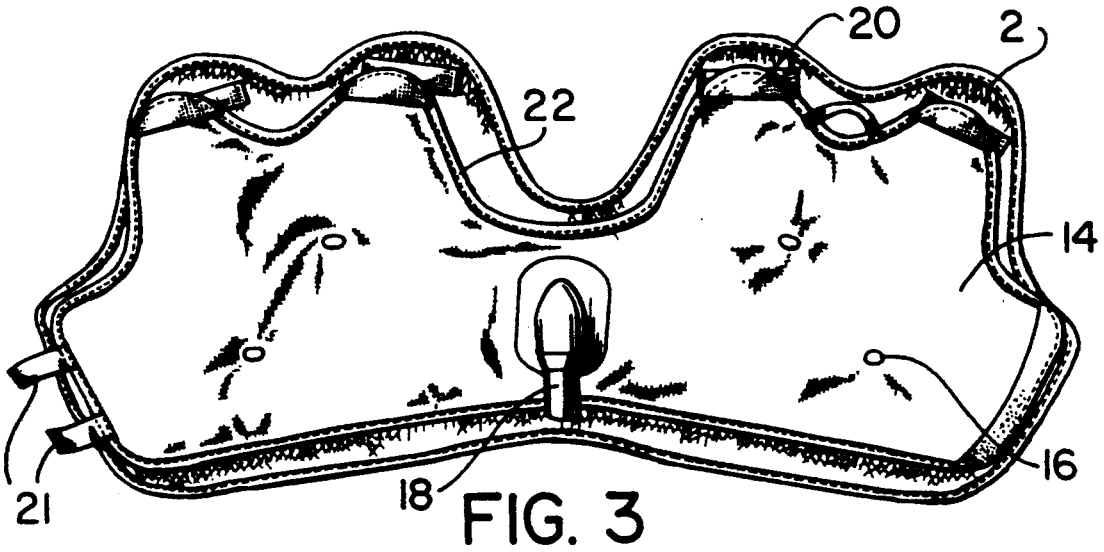
FIG. 3 is a diagrammatic representation of the air vest showing the opposite surface of the distribution manifold of FIG. 2.

In FIGS. 2 and 3 the shape of the manifold and vest can be seen as designed to fit on a user so as to cover the front and back of the user.

The manifold 6 of FIG. 2 is provided with perforations 10 throughout the inner layer 8 to permit the flow of cooling air therethrough. Bonding portions, such as 16, are shown in FIGS. 2 and 3 and join the two impermeable layers 8 and 14 to prevent them from separating which could result in the intermediate layer becoming dislodged.

Stitching is used as a means of bonding and the layers are sewn together at the periphery, as at 22 in FIG. 3. In alternate embodiments other fastening methods were used and in one early constructed version the bonding portions 16 were "hook" and "pile" fasteners which interfaced the manifold and the inner spacer.

Inlet means for a gaseous fluid in the form of an inlet port 18 is shown in FIG. 3. For aircrew, the gaseous fluid may, of course, be cooling air. In FIG. 3 there are also shown, loops and "hook" fasteners 20 and 21 at the top on the outside surface which are used to interface with the external pressure garment of the user.

Figure 4:
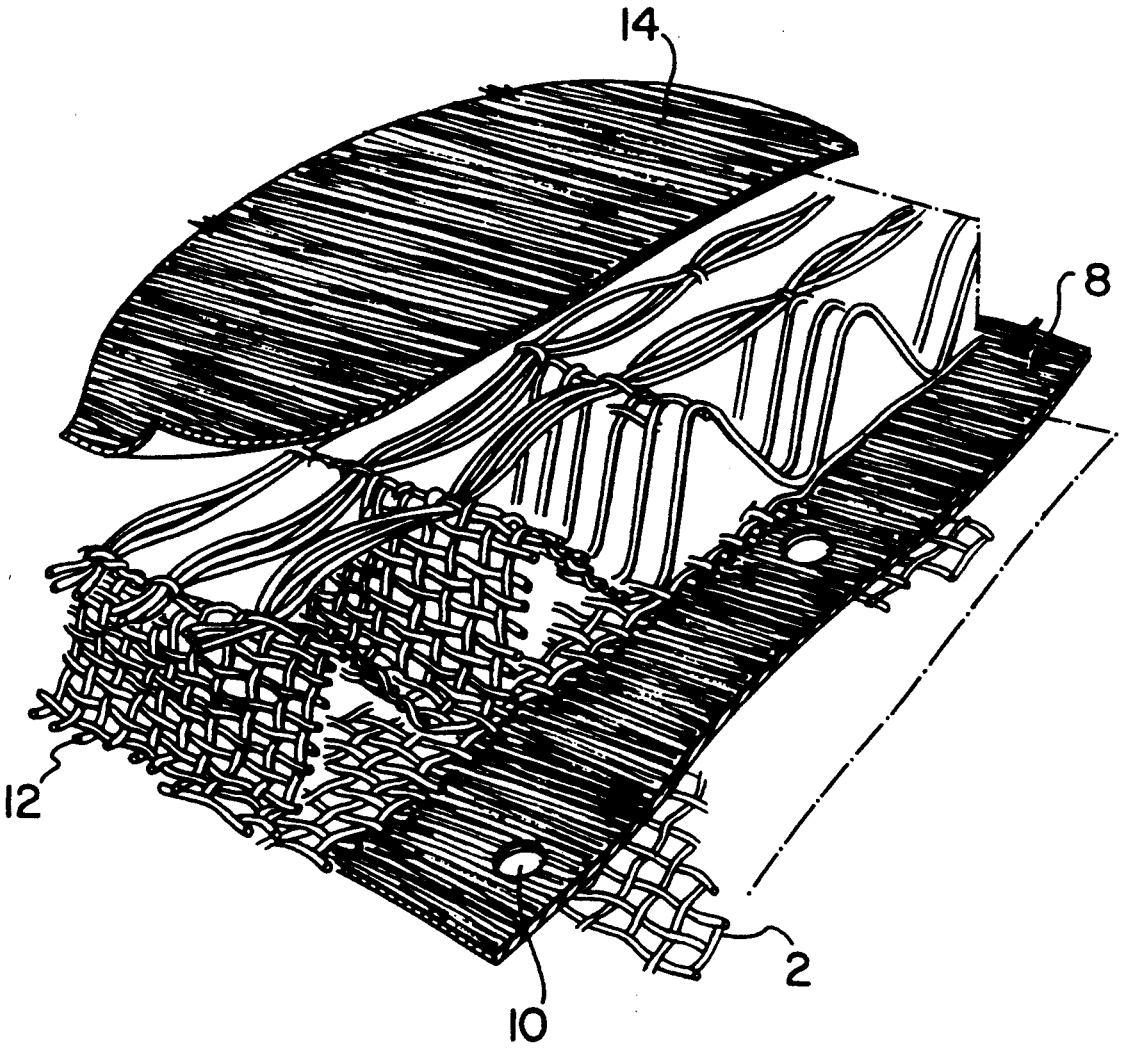
FIG. 4 is a diagrammatic representation of part of the air vest of FIG. 3 opened up to show constructional details of the air vest.

Part of the vest for aircrew is shown in FIG. 4 as an enlarged portion which is opened up to show the vest's constructional details. The inner first layer 2 is shown to be constructed of spacer mesh of open construction to facilitate the flow of air therethrough across and close to the body of the user from perforations 10 in the second layer 8. The third layer 12 will also be seen to be of open construction whilst the outer fourth layer 14 is shown as constructed of impermeable material.

There has been described above, a manifold comprising an outer layer of impermeable material, incorporating an air inlet port, bonded peripherally to a perforated inner layer of similar material, the two layers sandwiching a spacer mesh. The described design of an air distribution system specifically provides for low flow resistance, compatibility with a snug-fitting counter pressure garment, uniform flow distribution as well as efficient cooling performance. The manifold spacer mesh provides a low-resistance flow path to the vest periphery. The described vest can be operated with an inlet pressure typical of an aircraft environmental conditioning system. The inner spacer mesh also directs the air across and close to the body, which ensures that it remains in proximity to the body long enough to use a good portion of the cooling potential; hence efficient cooling performance is achieved. The proposed air cooling vest has been demonstrated to be clearly superior to a prior liquid cooling vest in an extreme (hot) environment using appropriate operating parameters with the respective systems. General and even air distribution was easily controlled by appropriate selection of perforation sites on the inner layer of the manifold. This is an advantage over prior air vest distribution networks which tend to be complex, difficult to manufacture, and susceptible to individual flow path blockage and uneven distribution. Furthermore, with many small-diameter distribution lines, prior air vests at required flow rates incur a pressure loss of more than the operating pressure of environmental conditioning systems in applicable aircraft. Although the capacity of these conditioning systems generally far exceeds the requirements for personal cooling, they cannot be used with present design air cooled vests because of insufficient driving pressure. The amount of cooling required can vary quite drastically as environment and/or workload change but, with a given chiller unit setting, cooling rate is essentially fixed. The significant potential of the natural and somewhat self-regulating process of evaporative cooling is not and cannot be used.

The term "manifold" has been used above for convenience and in its general sense since, in some constructions, the inner (spacer) layer 2 was built as a separate item. However, it will be understood that the invention is not restricted thereto. The cooling vest is effectively of a four-layer construction and the inner spacer layer 2, the perforated impermeable layer 8 and the outer impermeable layer 14 can be sewn together with the other spacer 12 (FIG. 1) contained between the two impermeable layers 8 and 14.

Instead of sewing the layers together, they can be sealed around the periphery thereof. It will be appreciated that a tight seal is not essential as minor leakage is acceptable.

The vest may be used to collect and remove air with cooling air supplied into other garmentry in another way. Thus the inlet port 18 would operate as an outlet port. Furthermore, the fluid used may, alternatively, be the vapours of liquid nitrogen or another cold compressed gas.

The type or composition of spacer mesh material depends on a number of factors including adequately balanced thickness, air flow resistance, compression resistance, weight and compliance to provide the desired characteristics compatible with the air supply and the other clothing worn by the user. It was found that with slightly more driving pressure available in the cool air source, a spacer mesh of smaller thickness (but higher air flow resistance) achieved the same cooling effect. The important issue seems to be the use of spacer mesh in the manifold to provide air flow at all holes of the inner perforated air-impermeable material even under tight fitting external garments, and a similar spacer between the manifold and the body to ensure a relatively low-resistance air flow path over the body surface.

Factors such as flammability will dictate the composition of the mesh. It was found that a polyethylene/polypropylene mesh worked satisfactorily but even spring steel wire suitably "woven" appeared to be satisfactory.

The type of impermeable (fabric) material may similarly be of any suitable type, the main factor being that it is impermeable to air. A urethane-coated nylon was used since it was available together with fabrication techniques therefor such as RF-sealing to form the manifold for air distribution. Several other materials with similar air-impermeable properties, e.g. rubberized cotton could, alternatively, be used. Sealing of the edges was achieved by using RF-sealing but adhesives appropriate to fabric coating could, of course, be used. As mentioned above, adequate manifold performance was achieved by simply stitching the impermeable layers together, since a small amount of air leakage around the periphery of the manifold is not overly detrimental. Using conventional sewing techniques air-impermeable fabrics such as Goretex TM, Dermaflex TM, and Entrant TM could be used for the manifold.

The invention has been described above with reference to an aircrew cooling vest. It will be understood that it is not restricted thereto but is equally applicable to other applications, for example by firemen. The invention is also applicable to leggings of some sort, and a cooling cap of similar design could be incorporated into a helmet for head cooling. An important feature is a broad distribution of air over the surface to be cooled and the ability to achieve this distribution with relatively low driving pressures. The principles of the invention are equally applicable to the provision of heat to the human body in cold environments.

It will be readily apparent to a person skilled in the art that a number of variations and modifications can be made without departing from the true spirit of the invention which will now be pointed out in the appended claims.

We claim:

1. Heat control means for an animal body comprising:

(a) an inner first layer of spacer mesh material, (b) a second layer of impermeable material, impermeable to a cooling fluid, said second layer adjacent said inner layer and having perforations therethrough adjacent said inner layer, (c) a third layer of spacer mesh material adjacent and outside the second layer, and (d) an outer layer of impermeable material, (e) said heat control means being provided with means for connecting the layers to a flow means for gaseous fluid.

2. Micro-climate conditioning clothing comprising:

(a) an inner first layer of spacer mesh material, (b) a second layer of impermeable material, impermeable to a fluid, said second layer in contact with said first layer and having perforations therethrough adjacent said first layer, (c) a third layer of spacer mesh material on an outer side of said second layer and (d) a fourth layer of impermeable material on a side of said third layer remote from said second layer, (e) the second and fourth layers being fastened together along at least part of their edges to form a space therebetween, and (f) fluid flow means connected to said space for fluid flow connection thereto.

3. Micro-climate conditioning clothing according to claim 2 wherein said first, second and fourth layers are fastened together.

4. Micro-climate conditioning clothing according to claim 2 or 3 wherein said layers are fastened together by stitching.

5. Micro-climate conditioning clothing according to claim 2 or 3 wherein said layers comprise RF-sealable materials, and are fastened together by an RF-sealing process.

6. Micro-climate conditioning clothing according to claim 2 which is an aircrew cooling vest for cooling the body of an aircrew person.

7. Micro-climate conditioning clothing according to claim 3 which is an aircrew cooling vest for cooling the body of an aircrew person.

8. An aircrew cooling vest according to claim 6 or 7 wherein said fluid flow means is air inlet means sealed to an opening in said fourth layer.

9. An aircrew cooling vest according to claim 6 wherein hook and pile fasteners are provided to interface said first layer and said second layer.

10. An aircrew cooling vest according to claim 6, 7 or 9 wherein hook-and-loop fastener material is provided on an outside surface of the fourth layer to interface with an external pressure garment.

11. Micro-climate conditioning clothing according to claim 2, 3 or 6 wherein said perforations are provided over only a part of said second layer at selected sites for appropriate control of air distribution.

12. Micro-climate conditioning clothing according to claim 7 or 9 wherein said perforations are provided over only a part of said second layer at selected sites for appropriate control of air distribution.

13. Heat control means for an animal body comprising:

(a) an inner layer of spacer mesh material and, (b) a manifold member, outside the inner layer, made up of a layer of impermeable material, impermeable to a gaseous fluid, said impermeable material in contact with said inner layer and having perforations therethrough adjacent said inner layer, an outer layer of impermeable material and an intermediate layer of spacer mesh material, (c) said manifold member being provided with means for connecting the layers to a flow means for gaseous fluid.

14. Air cooling clothing for cooling an animal body comprising:

(a) an inner layer of spacer mesh material and, (b) a manifold member, outside the inner layer, made up of a first layer of impermeable material, impermeable to air, said first layer in contact with said inner layer and having perforations therethrough adjacent said inner layer, a second outer layer of impermeable material and an intermediate layer of spacer mesh material between said first and second layers of impermeable material, (c) said manifold member being provided with connection means for providing a flow of air.

15. An air cooling vest for cooling an animal body comprising:

(a) an inner layer of spacer mesh material and, (b) a manifold member, outside the inner layer, made up of a first layer of impermeable material, impermeable to air, said first layer in contact with said inner layer and having perforations therethrough adjacent said inner layer, a second outer layer of impermeable material and an intermediate layer of spacer mesh material between said first and second layers of impermeable material, (c) said manifold member being provided with connection means for providing a flow of air.

16. An air cooling vest according to claim 15 wherein said first and second layer soft impermeable material are fastened together around their edges.

17. A vest according to claim 16 wherein said first and second layers are stitched around their edges.

18. A vest according to claim 16 wherein said first and second layers are sealed together around their edges.

19. An aircrew air cooling vest for cooling the body of an aircrew person comprising:

(a) an inner layer of spacer mesh material for contact with said body and (b) a manifold member made up of a first layer of impermeable material, impermeable to air, said first layer in contact with said inner layer and having perforations therethrough adjacent said inner layer, a second outer layer of impermeable material and an intermediate layer of spacer mesh material between said first and second layers of impermeable material, (c) said manifold member being provided with connection means for providing a flow of air.

20. A vest according to claim 15, 16 or 19 wherein said connection means is sealed to an opening in said second layer of impermeable material.

21. A vest according to claim 15, 16 or 19 wherein hook and pile fasteners are provided to interface said manifold and said inner layer of spacer mesh material.

22. A vest according to claim 15, 16 or 19 wherein hook-and-loop fastener material is provided on an outside surface of the second layer of impermeable material interface with an external pressure garment.

23. A vest according to claim 15, 16 or 19 wherein said perforations are provided over only a part of said first layer at selected sites for appropriate control of air distribution.

* * * * *

UNITED STATES PATENT AND TRADEMARK OFFICE

CERTIFICATE OF CORRECTION

PATENT NO. : 5,243,706

DATED : September 14, 1993

INVENTOR(S) : John Frim, Bramalea; Robert D. E. Michas, Brampton, both of Canada It is certified that error appears in the above-identified patent and that said Letters Patent is hereby corrected as shown below:

In Column 6, line 26 of the printed patent, change "layer" to --layers--.

Column 6, line 26 of the printed patent, change "soft" to --of--

Signed and Sealed this

Twelfth Day of April, 1994

Bruce Lehman

BRUCE LEHMAN

*Commissioner of Patents and Trademarks*

*Attest:*

*Attesting Officer*